US008930050B2

(12) United States Patent
Garon et al.

(10) Patent No.: US 8,930,050 B2
(45) Date of Patent: Jan. 6, 2015

(54) METHOD AND SYSTEM FOR INCREASING OR DECREASING ENGINE THROTTLE IN A MARINE VESSEL

(75) Inventors: Pierre Garon, Trois-Rivières (CA); Neil Garfield Allyn, Vancouver (CA); Ray Tat Lung Wong, Richmond (CA)

(73) Assignee: Marine Canada Acquisition Inc., Richmond (CA)

( * ) Notice: Subject to any disclaimer, the term of this patent is extended or adjusted under 35 U.S.C. 154(b) by 625 days.

(21) Appl. No.: 12/703,300

(22) Filed: Feb. 10, 2010

(65) Prior Publication Data

US 2010/0280685 A1 Nov. 4, 2010

(51) Int. Cl.

| | |
|---|---|
| ***B63H 21/21*** | (2006.01) |
| ***B63H 21/22*** | (2006.01) |
| ***F02D 41/24*** | (2006.01) |
| ***F02D 11/10*** | (2006.01) |

(52) U.S. Cl.

CPC ..... *F02D 11/106* (2013.01); *F02D 41/2432* (2013.01); *F02D 41/2464* (2013.01); *F02D 2250/16* (2013.01); *F02D 2200/0404* (2013.01); *B63H 21/213* (2013.01)

USPC ..... 701/21; 440/87

(58) Field of Classification Search

CPC ..... B63H 21/213

USPC ..... 701/50, 110, 93, 21; 123/352, 683; 180/170; 440/84–87

See application file for complete search history.

(56) References Cited

U.S. PATENT DOCUMENTS

| | | | | |
|---|---|---|---|---|
| 4,071,818 | A | | 1/1978 | Krisst |
| 4,350,041 | A | | 9/1982 | Loker et al. |
| 4,898,132 | A | | 2/1990 | Kanno |
| 4,950,988 | A | | 8/1990 | Garshelis |
| 5,074,810 | A | * | 12/1991 | Hobbs et al. ..... 440/2 |
| 5,228,548 | A | | 7/1993 | Bohlin |
| 5,350,328 | A | * | 9/1994 | Yagi ..... 440/84 |
| 5,700,171 | A | * | 12/1997 | Horton ..... 440/87 |
| 6,026,783 | A | * | 2/2000 | Nestvall et al. ..... 123/399 |
| 6,280,269 | B1 | * | 8/2001 | Gaynor ..... 440/84 |
| 6,587,765 | B1 | | 7/2003 | Graham et al. |
| 6,595,179 | B1 | | 7/2003 | Kanno |
| 6,704,643 | B1 | | 3/2004 | Suhre et al. |
| 6,823,745 | B2 | | 11/2004 | Goto et al. |
| 6,871,555 | B2 | | 3/2005 | May |

(Continued)

FOREIGN PATENT DOCUMENTS

| | | | | |
|---|---|---|---|---|
| CA | 2069803 C | * | 12/1997 | ..... B63H 21/21 |
| WO | WO 97/03282 | | 1/1997 | |

OTHER PUBLICATIONS

U.S. Appl. No. 12/424,733 Specification, filed Apr. 16, 2009.*

(Continued)

*Primary Examiner* — Behrang Badii
*Assistant Examiner* — David Testardi
(74) *Attorney, Agent, or Firm* — Cameron IP

(57) ABSTRACT

A method of adjusting engine throttle in an electronic shift and throttle system comprises determining a position of a control lever which allows an operator to manually control throttle functions. A throttle command is calculated based on the position of the control lever. The throttle command is adjusted in response to an input received from an input means. The position of the control lever remains constant as the throttle command is being adjusted.

10 Claims, 21 Drawing Sheets

(56) References Cited

U.S. PATENT DOCUMENTS

| | | | | |
|---|---|---|---|---|
| 6,918,803 | B2 * | 7/2005 | Shomura | 440/88 A |
| 7,036,485 | B1 | 5/2006 | Koerner | |
| 7,131,339 | B2 | 11/2006 | Kwun et al. | |
| 7,133,758 | B2 | 11/2006 | Otto et al. | |
| 7,142,955 | B1 | 11/2006 | Kern et al. | |
| 7,179,143 | B2 | 2/2007 | Mizuguchi et al. | |
| 7,201,620 | B2 * | 4/2007 | Kinoshita et al. | 440/1 |
| 7,330,782 | B2 | 2/2008 | Graham et al. | |
| 7,335,070 | B2 | 2/2008 | Yoda et al. | |
| 7,357,120 | B2 * | 4/2008 | Kaji | 123/360 |
| 7,384,321 | B2 | 6/2008 | Muramatsu et al. | |
| 7,469,604 | B2 | 12/2008 | Hedayat et al. | |
| 7,680,582 | B2 * | 3/2010 | Ishida et al. | 701/103 |
| 8,092,264 | B2 * | 1/2012 | Kinoshita et al. | 440/1 |
| 2004/0090195 | A1 | 5/2004 | Motsenbocker | |
| 2005/0240333 | A1 * | 10/2005 | Bauerle et al. | 701/93 |
| 2006/0166573 | A1 | 7/2006 | Vetta et al. | |
| 2007/0227268 | A1 | 10/2007 | Ouyang et al. | |
| 2008/0216589 | A1 | 9/2008 | Shimizu | |
| 2009/0287394 | A1 | 11/2009 | Ishida et al. | |
| 2010/0121539 | A1 * | 5/2010 | Price et al. | 701/50 |

OTHER PUBLICATIONS

"Electronic Engine Controls by Glendinning, Installation & Operation Manual", v8.0A (software version 8), EEC1M_v8.0A, published by Glendinning Marine Products, Inc., Nov. 2006, 131 pages, downloaded from http://67.210.120.197/pdfs/eec1m_v8a.pdf.*

"Glendinning Electronic Engine Controls Operation Guide", Ver.1.3 (includes software version 5), published by Glendinning Marine Products, Inc., Sep. 3, 2003, 45 pages, downloaded from http://67.210.120.197/pdfs/eec_ops_instructions_v5.pdf.*

"Glendinning Electronic Engine Control—EEC 2001—Operations & Installation Manual v10 (software version 1.5)", published by Glendinning, Mar. 2002, 56 pages, downloaded from http://67.210.120.197/pdfs/eec2001_manual_v1.0.pdf.*

Boat Review, "Yamaha 242 Limited S", Boating Magazine, Sep. 29, 2009, 5 pages, downloaded from http://www.boatingmag.com/boats/yamaha-242-limited-s-0.*

Glendinning Marine Products, Smart Actuator II™ Installation & Operation Manual, Jul. 2008, Version 3.7b, 103 pages.*

Mercury Marine, "DTS Dual Console Remote Control with CAN Trackpad, Installation Instructions 877775A_", 90-889224, May 2006, 17 pages.*

Salt Water Sportsman article, "New age engine controls", Sep. 21, 2007, 5 pages, downloaded from http://www.saltwatersportsman.com/new-age-engine-controls.*

AS5045 12 Bit Programmable Magnetic Rotary Encoder, www.austriamicrosystems.com, 2008.

AS5000 Series Magnetic Sensor Circuits, Magnet Selection Guide, www.austriamicrosystems.com, 2008.

BRP Evinrude Icon Interactive Control System Press Release, Feb. 12, 2009, Bombardier Recreational Products Inc., Miami, Florida.

* cited by examiner

| Lever position | Gear command | Throttle command | Gear lamps |
|---|---|---|---|
| FORWARD WOT | Forward | 100% | 32 |
| FORWARD | Forward | 0 - 100% | |
| FORWARD DETENT | Forward | 0% | |
| NEUTRAL DETENT | Neutral | 0% | 34 |
| REVERSE DETENT | Reverse | 0% | |
| REVERSE | Reverse | 0 - 60% | |
| REVERSE WOT | Reverse | 60% | 36 |

FIG. 6

METHOD AND SYSTEM FOR INCREASING OR DECREASING ENGINE THROTTLE IN A MARINE VESSEL

BACKGROUND OF THE INVENTION

1. Field of the Invention

The present invention relates to electronic shift and throttle systems and, in particular, to increasing and decreasing engine throttle.

2. Description of the Related Art

Vehicles such as marine vessels are often provided with electronic shift and throttle systems. These systems typically allow an operator to control the shift and throttle functions of a propulsion unit using a control lever which is pivotally mounted on a control head. The control lever is moveable between a forward wide open throttle (forward WOT) position and a reverse wide open throttle (reverse WOT) position, through a neutral position. A controller reads the position of the control lever as the control lever moves through its operational range. The controller sends shift commands and throttle commands which drive a shift actuator and a throttle actuator based on the position of the control lever.

For example, U.S. Pat. No. 7,330,782 issued on Feb. 12, 2008 to Graham et al. and the full disclosure of which is incorporated herein by reference, discloses an electronic shift and throttle system in which a position sensor is used to sense the position of a control lever. The position sensor is electrically connected to an electronic control unit (ECU) and sends an electrical signal to the ECU. The ECU is able to determine the position of the control lever based on the voltage level of the electrical signal received from the position sensor. The ECU then determines the positions to which the output shafts of the shift actuator and the throttle actuator should be set.

Each of the output shafts is also coupled to a corresponding position sensor. Electrical signals sent by these position sensors may be used to determine the positions of the output shafts. This feedback may be used to govern the ECU. This is beneficial because variances and play between components used to link throttle actuators to throttles make it desirable to calibrate throttle controls. Calibrated throttle controls allow an operator to more accurately increase or decrease engine throttle in a marine vessel.

SUMMARY OF THE INVENTION

It is an object of the present invention to provide an improved method and system for increasing or decreasing engine throttle in a marine vessel.

There is accordingly provided a method of adjusting engine throttle in an electronic shift and throttle system. The method comprises determining a position of a control lever which allows an operator to manually control throttle functions. A throttle command is calculated based on the position of the control lever. The throttle command is adjusted in response to an input received from an input means. The position of the control lever remains constant as the throttle command is being adjusted.

In a one embodiment of the method, the throttle command is calculated using a throttle curve and the throttle command is adjusted by 1% in response to each input received from the input means to a maximum of 5%. In another embodiment of the method, the throttle command is adjusted by 0.5% in response to each input received from the input means to a maximum of 10%. The throttle command may be increased or decreased. The throttle command is only adjusted if all running engines are in forward gear and the adjusted throttle signal is sent to engine controllers of all running engines. The adjusted throttle command is cancelled when the control lever is moved.

Also provided is an electronic shift and throttle system which comprises a control head including a pivotable control lever for manually controlling throttle functions of an engine. The control lever is moveable through a range of positions. The engine includes a throttle and a throttle actuator for moving the throttle between an idle position and a wide open throttle position. An engine control unit provides a throttle command causing the throttle actuator move the throttle based on a position of the control lever. An input means is provided to allow an operator to increases or decrease the throttle command without having to move to control lever. Preferably the input means is a button disposed on the control head.

The present invention provides an improved system and method for increasing or decreasing engine throttle which allows an operator fine tune engine throttle. The present invention also allows an operator increase or decrease engine throttle without having to move a control lever.

BRIEF DESCRIPTIONS OF DRAWINGS

The invention will be more readily understood from the following description of the embodiments thereof given, by way of example only, with reference to the accompanying drawings, in which:

FIG. 6 is a table illustrating the lighting of indicator or gear lamps as the control lever of FIG. 5 is moved through the operational range;

DESCRIPTION OF THE PREFERRED EMBODIMENTS

Figure 1:
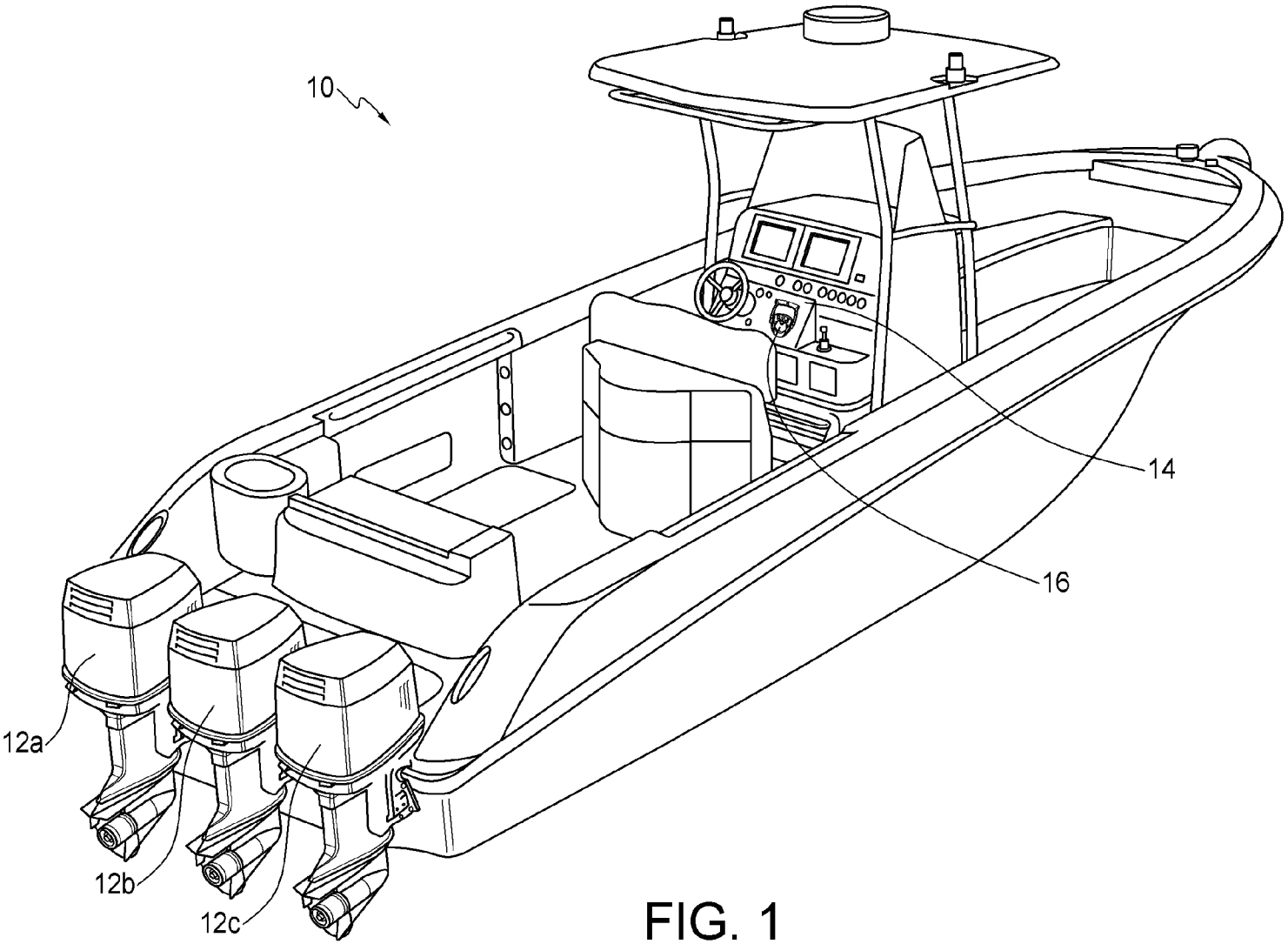
FIG. 1 is a perspective view of a marine vessel provided with a plurality of propulsion units and an improved electronic shift and throttle system.

Referring to the drawings and first to FIG. 1, this shows a marine vessel 10 which is provided with a plurality of propulsion units in the form of three outboard engines 12*a*, 12*b* and 12*c*. However, in other examples, the marine vessel 10 may be provided with any suitable number of inboard and/or outboard engines. It is common to see two engines and practically up to five engines in pleasure marine vessels. The marine vessel 10 is also provided with a control head station 14 that supports a control head 16. The control head 16 is provided with a microprocessor (not shown).

Figure 2:
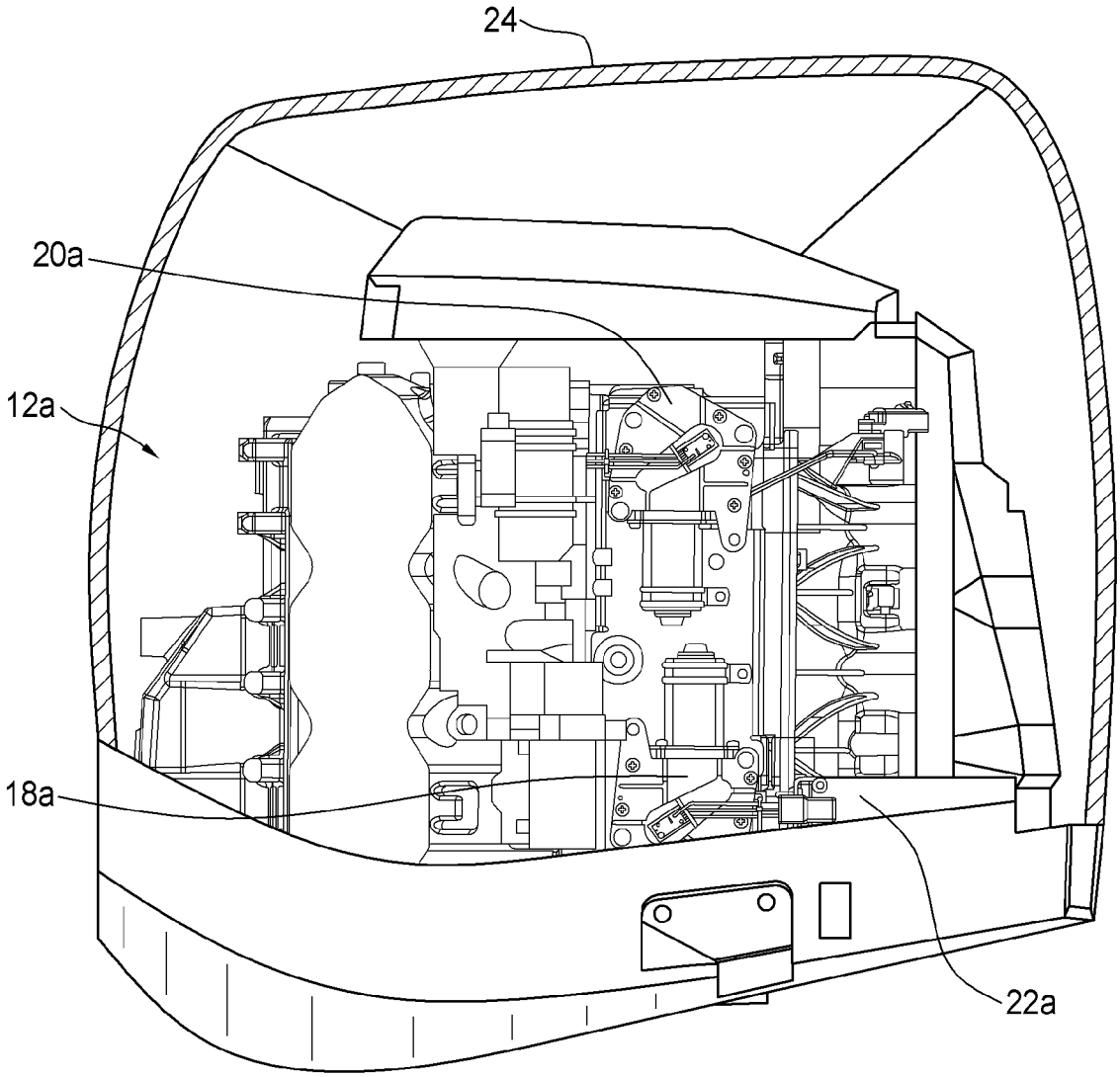
FIG. 2 is a side view of an engine of one of the propulsion units of FIG. 1.

A first one of the engines, namely the port engine 12*a*, is best shown in FIG. 2. The port side engine 12*a* includes a shift actuator 18*a*, a throttle actuator 20*a*, and an electronic servo module (ESM) 22*a*; all of which are disposed within a cowling 24. Second and third ones of the engines, namely the center engine 12*b* and starboard 12*c* engine, have substantially the same structure as the port engine 12*a* and are accordingly not described in detail herein.

Figure 3:
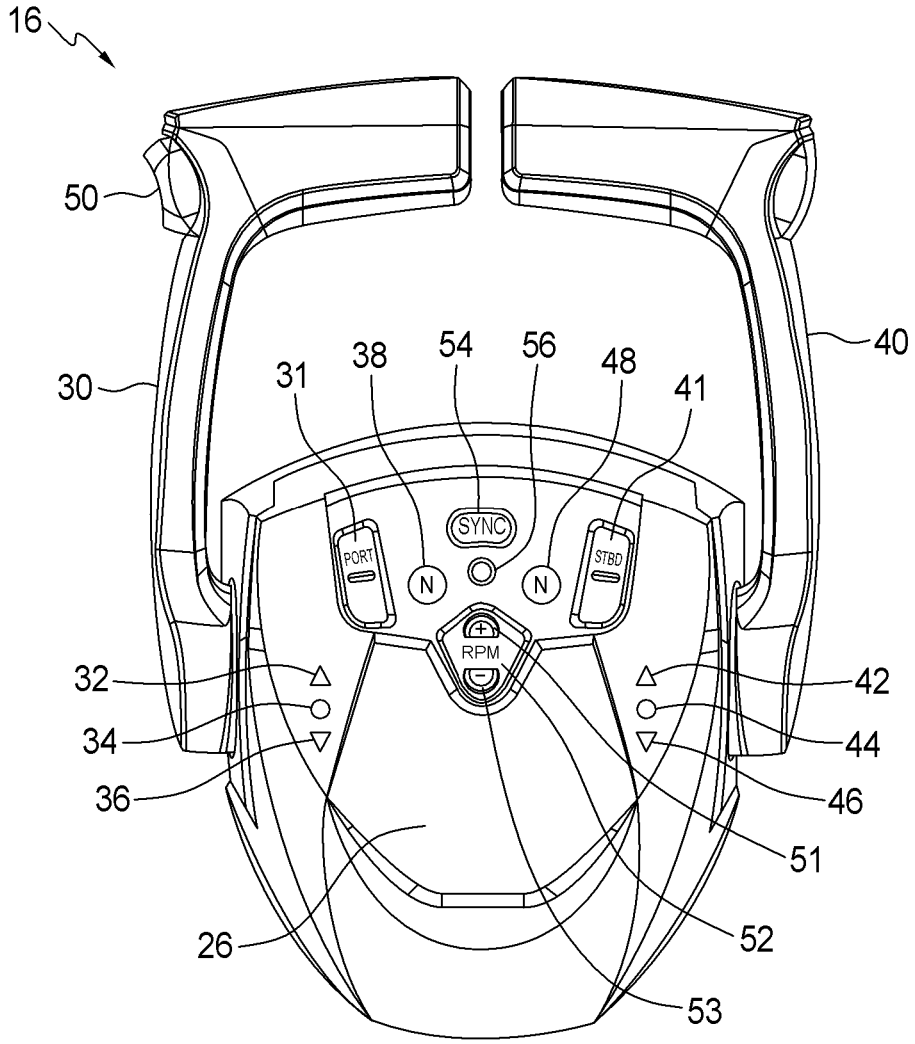
FIG. 3 is a top view of the a control head of the marine vessel of FIG. 1.

The control head 16 is best shown in FIG. 3. The control head 16 includes a housing 26. A port control lever 30 and starboard control lever 40 are each pivotally mounted on the housing 26. The port control lever 30 normally controls the shift and throttle functions of the port engine 12*a* but, in this example, also controls the shift and throttle functions of the center engine 12*b* both of which are shown in FIG. 1. The starboard control lever 40 controls the shift and throttle functions of the starboard engine 12*c* which is also shown in FIG. 1. In a marine vessel with five engines, the port control lever would control the shift and throttle functions of the port, center port and center engines while the starboard control lever would control the shift and throttle functions of the starboard engine and starboard center engine.

The port control lever 30 is provided with a master trim switch 50 which allows an operator to simultaneously trim all of the engines. The port and starboard engines are trimmed individually using a respective port trim button 31 and starboard trim button 41, which are both disposed on the housing 26. The center engine 12*b* is under the control of a center trim button 31 (not shown).

The housing 26 also supports a plurality of indicator or gear lamps which, in this example, are LED lamps. A port forward indicator 32, port neutral indicator 34, and port reverse indicator 36 are disposed on a side of housing 26 adjacent the port control lever 30. A starboard forward indicator 42, starboard neutral indicator 44, and a starboard reverse indicator 46 are disposed on a side of housing 26 adjacent the starboard control lever 40. A port neutral input means 38 and starboard neutral input means 48 are also disposed on the housing 26. An RPM input means 52, synchronization (SYNC) input means 54, and SYNC indicator lamp 56 are also all disposed on the housing 26. In this example, the port neutral input means 38, starboard neutral input means 48, RPM input means 52, and SYNC input means 54 are buttons but any suitable input devices may be used.

Figure 4:
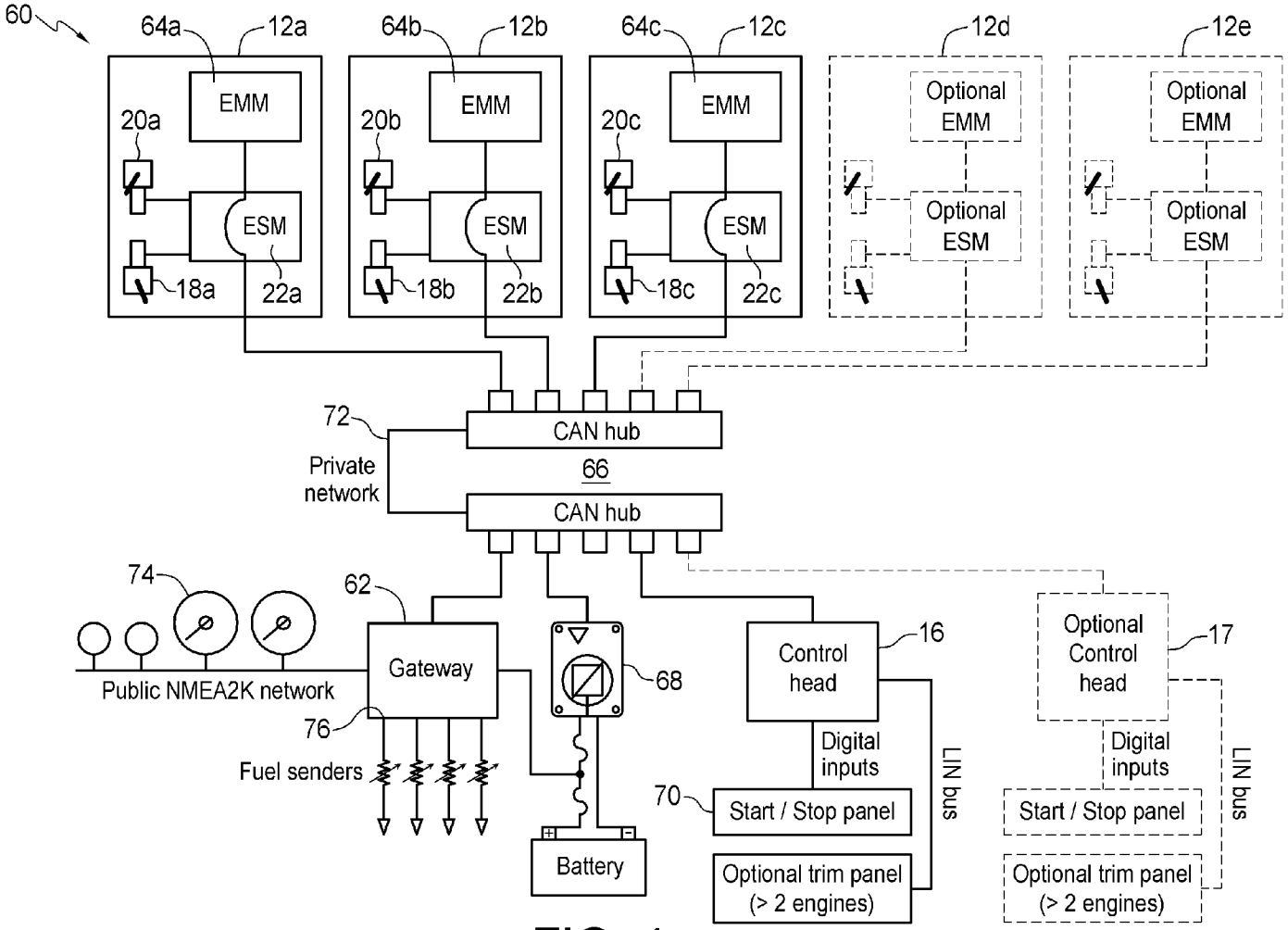
FIG. 4 is a schematic diagram illustrating the electronic shift and throttle system of FIG. 1.

As best shown in FIG. 4, the control head 16 and the engines 12*a*, 12*b* and 12*c*, together with their corresponding shift actuators 18*a*, 18*b* and 18*c*; throttle actuators 20*a*, 20*b* and 20*c*; and ESMs 22*a*, 22*b* and 22*c*, form part of an electronic shift and throttle system 60. The electronic shift and throttle system 60 further includes a gateway 62 and a plurality of engine management modules (EMMs) 64*a*, 64*b* and 64*c*. Each EMM is associated with a corresponding ESM. The control head, gateway, ESMs, and EMMs communicate with each other over a private CAN network 66. The electronic shift and throttle system 60 is designed to support two control heads and control up to five engines. Components of optional fourth and fifth engines 12*d* and 12*e* as well as an optional second control head 17 are shown in ghost.

A single master ignition switch 68 provides power to the entire private CAN network 66. However, start and stop functions are achieved by individual switches 70 read by the control head 16 as discrete inputs or serial data. Any command an operator inputs to the control head 16 to start, stop, trim, shift or accelerate one of the engines 12*a*, 12*b* or 12*c* is sent to the corresponding ESM 22*a*, 22*b* or 22*c* and corresponding EMM 64*a*, 64*b* or 64*c* over the CAN network 66. The ESMs and EMMs are each provided with a microprocessor (not shown). In this example, a private network cable 72 that carries the CAN lines from the control head 16 to the engines 12*a*, 12*b* and 12*c* has two separate wires used to shut down the engines in the event that the CAN network 66 fails.

Information from the electronic shift and throttle system 60 is made available to devices on a NMEA2K public network 74 through the gateway 62. The gateway 62 isolates the electronic shift and throttle system 60 from public messages, but transfers engine data to displays and gauges (not shown) on the public network 74. The gateway 62 is also provided with a plurality of analog inputs 76 which may be used to read and broadcast fuel senders or oil senders or other resistive type senders such as rudder senders or trim tab senders on the public network 74.

Figure 5:
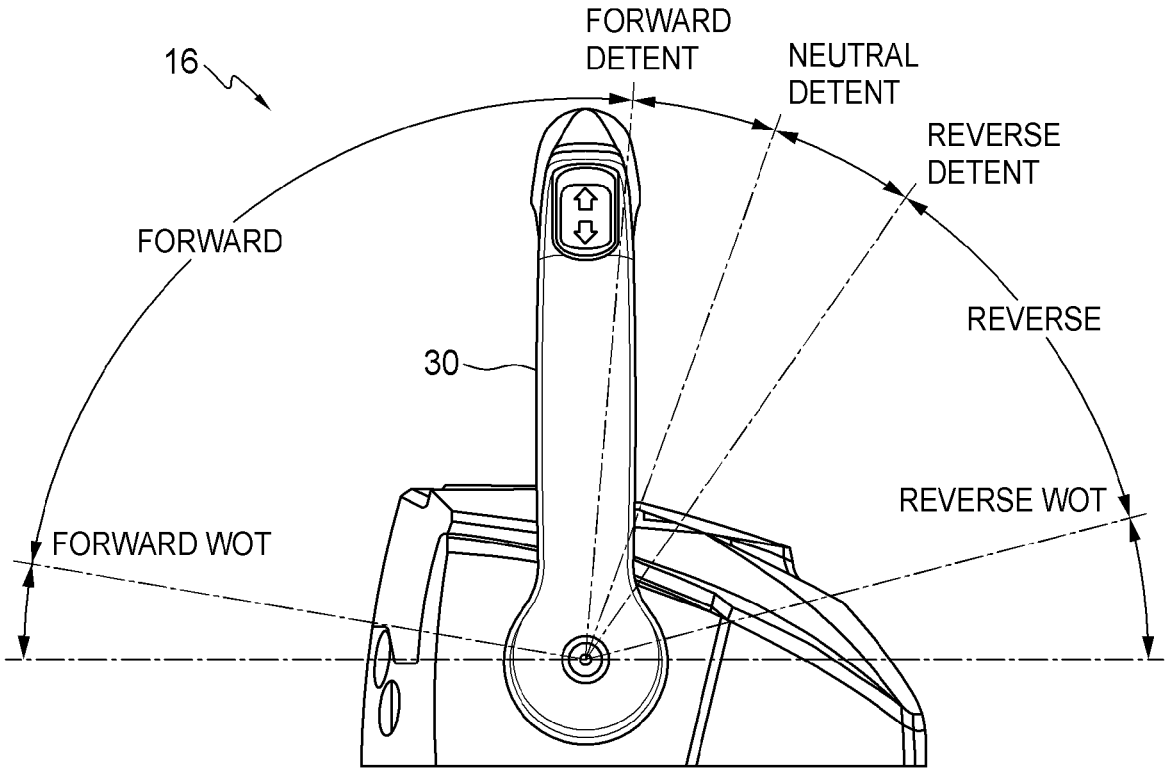
FIG. 5 is an elevation view of the control head of FIG. 3 illustrating an operational range of a control lever thereof.

Referring now to FIG. 5, the port side 30 control lever is moveable between a forward wide open throttle (forward WOT) position and a reverse wide open throttle (reverse WOT) position, through a neutral position. An operator is able to control the shift and throttle functions of the port engine 12*a* by moving the port control lever 30 through its operational range. The port control lever 30 is also provided with a forward detent, neutral detent, and reverse detent all disposed between the forward WOT position and reverse WOT position. This allows the operator to physically detect when the port control lever 30 has moved into a new shift/throttle position. As shown in FIG. 6, the port forward indicator 32, port neutral indicator 34, and port reverse indicator 36 light up to reflect the position of the port control lever 30 shown in FIG. 5.

Figure 7:
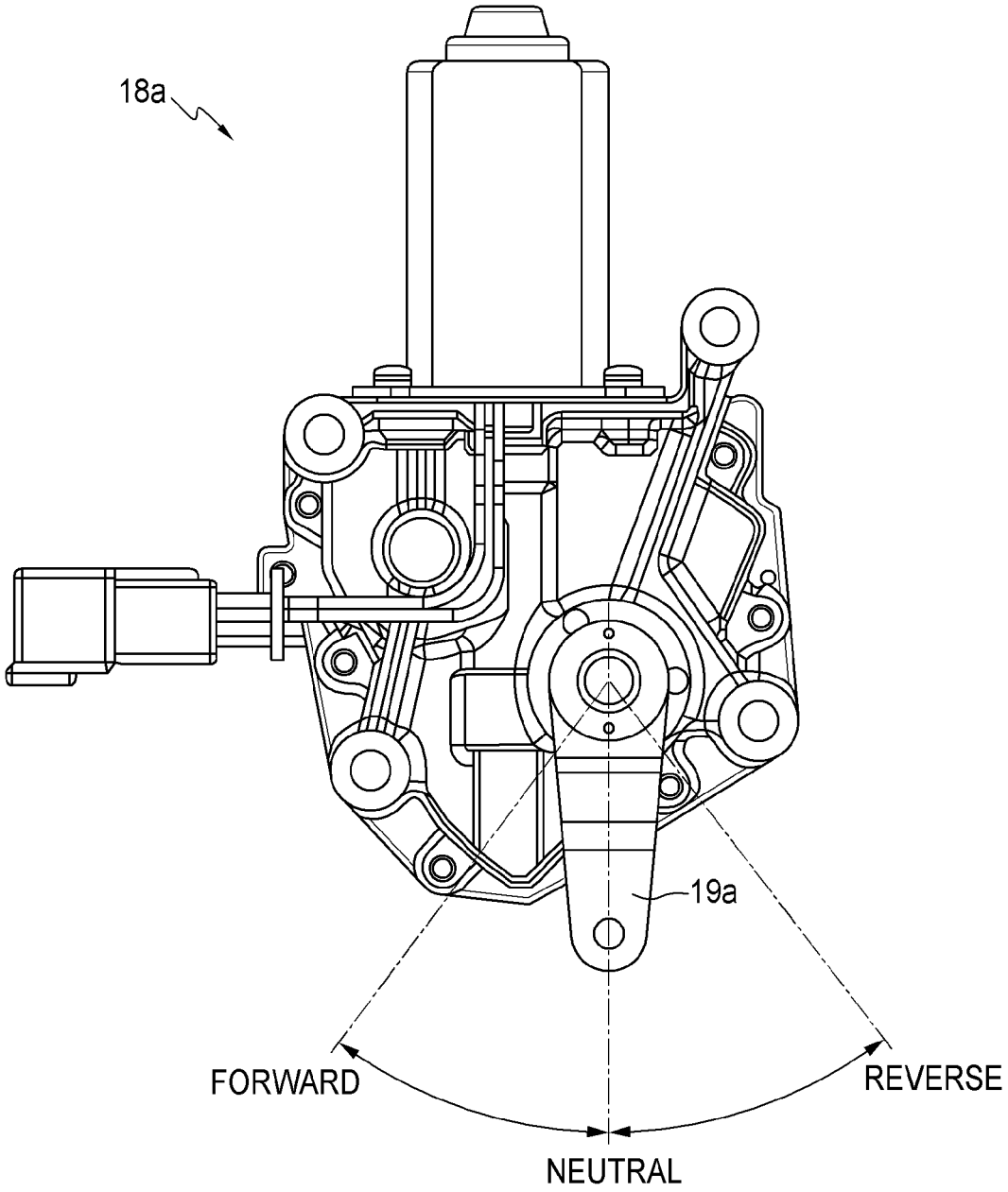
FIG. 7 is side elevation view of a shift actuator of the propulsion unit of FIG. 2 illustrating an operational range of an actuator arm thereof.
Figure 8:
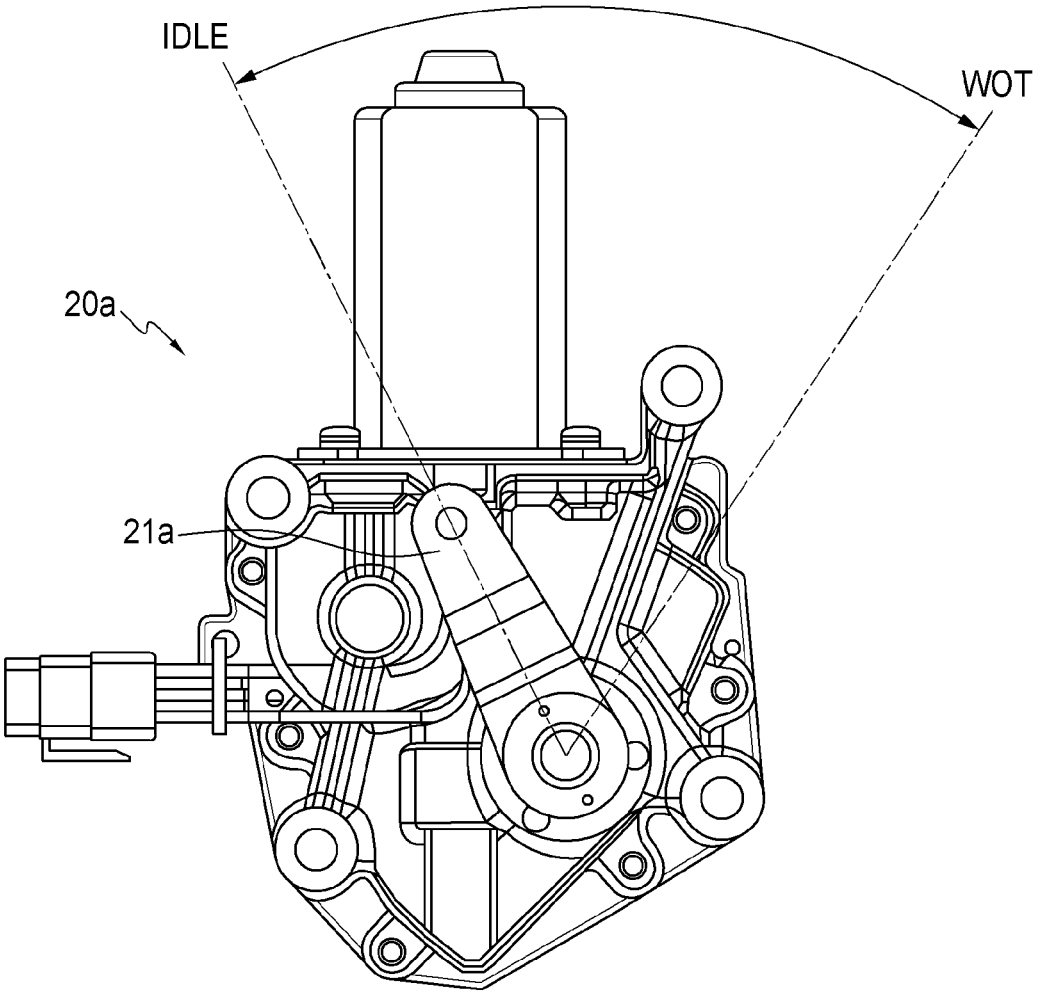
FIG. 8 is a side elevation view of a throttle actuator of the propulsion unit of FIG. 2 illustrating an operational range of an actuator arm thereof.

Referring back to FIGS. 4 and 5, the microprocessor supported by the control head 16 reads the position of the port control lever 30 and sends shift and throttle commands to the ESM 22*a* via the private CAN network 66. The ESM 22*a* commands the shift actuator 18*a* and throttle actuator 20*a* which are best shown in FIGS. 7 and 8, respectively. FIG. 7 shows that the shift actuator 18*a* has an actuator arm 19*a* which is moveable between a forward position and a reverse position with a neutral position therebetween. FIG. 8 shows that the throttle actuator 20*a* has an actuator arm 21*a* which is moveable between an idle position and a wide open throttle (WOT) position. An actuator position sensor 142, shown in FIG. 12, signals the actuator position to the ESM 22*a* shown in FIG. 4. This feedback may be used to govern the control head 16. The shift and throttle functions of the port side engine 12*a* are thereby controlled.

It will be understood by a person skilled in the art that the shift and throttle functions of the starboard engine 12*c* are controlled in a similar manner using the starboard control lever 40 shown in FIG. 2. The shift and throttle functions of the center engine 12*b* are under the control of the port control lever 30 in this example. Accordingly, as thus far described, the electronic shift and throttle system 60 is conventional.

However, the electronic shift and throttle control system 60 disclosed herein is provided with an improved shift actuator 18*a* and throttle actuator 20*a* as shown in Figures actuators as shown in FIGS. 7 and 8 respectively. The shift and throttle actuators are both rotary actuators which have substantially the same structure and function in substantially the same manner, with the exception of the actuator arm 19*a* or 21*a*. This will be understood by person skilled in the art. Accordingly, only the throttle actuator 20*a* is described in detail herein.

Figure 9:
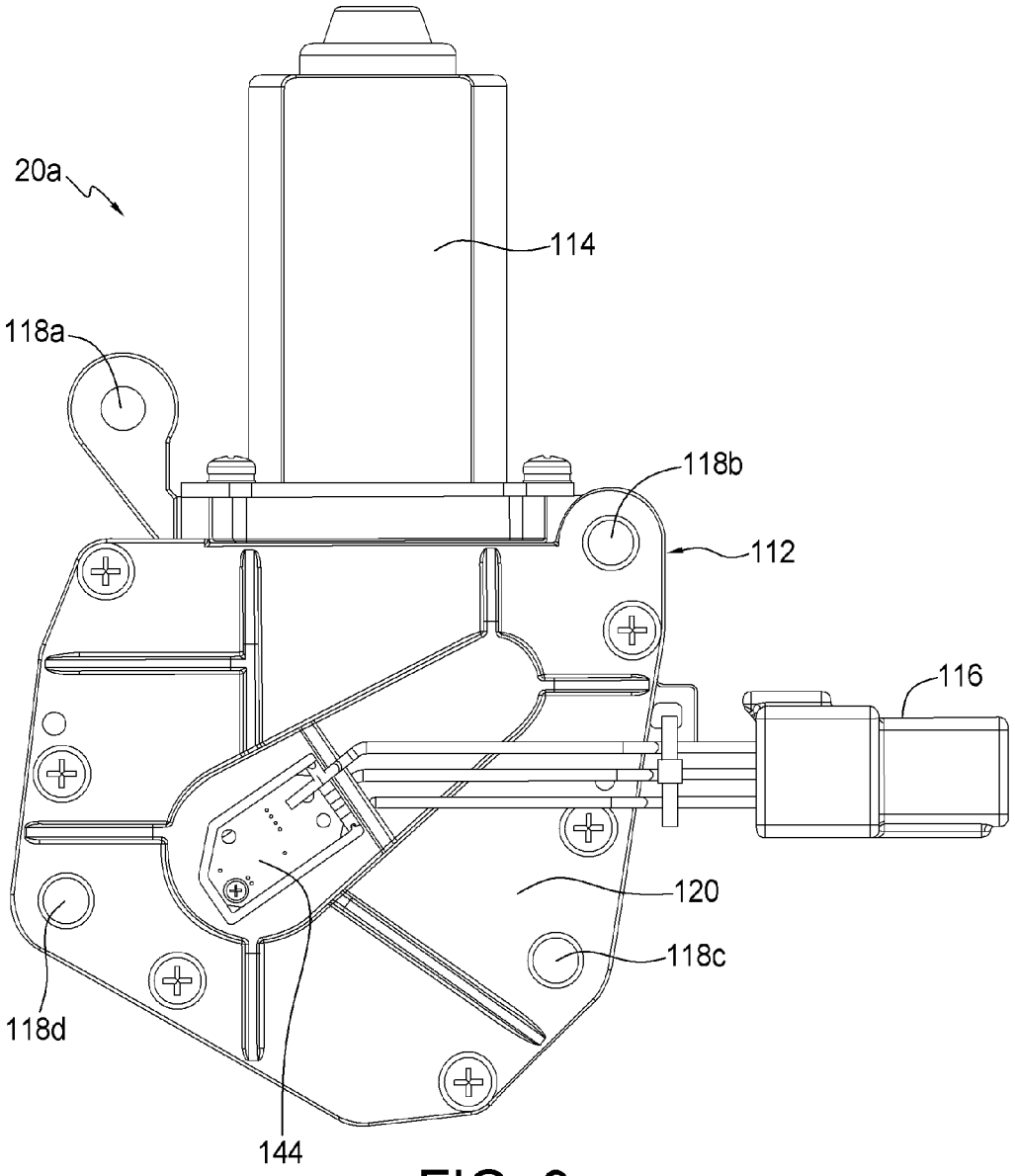
FIG. 9 is a side elevation view of the throttle actuator of FIG. 8 illustrating a second side thereof.
Figure 10:
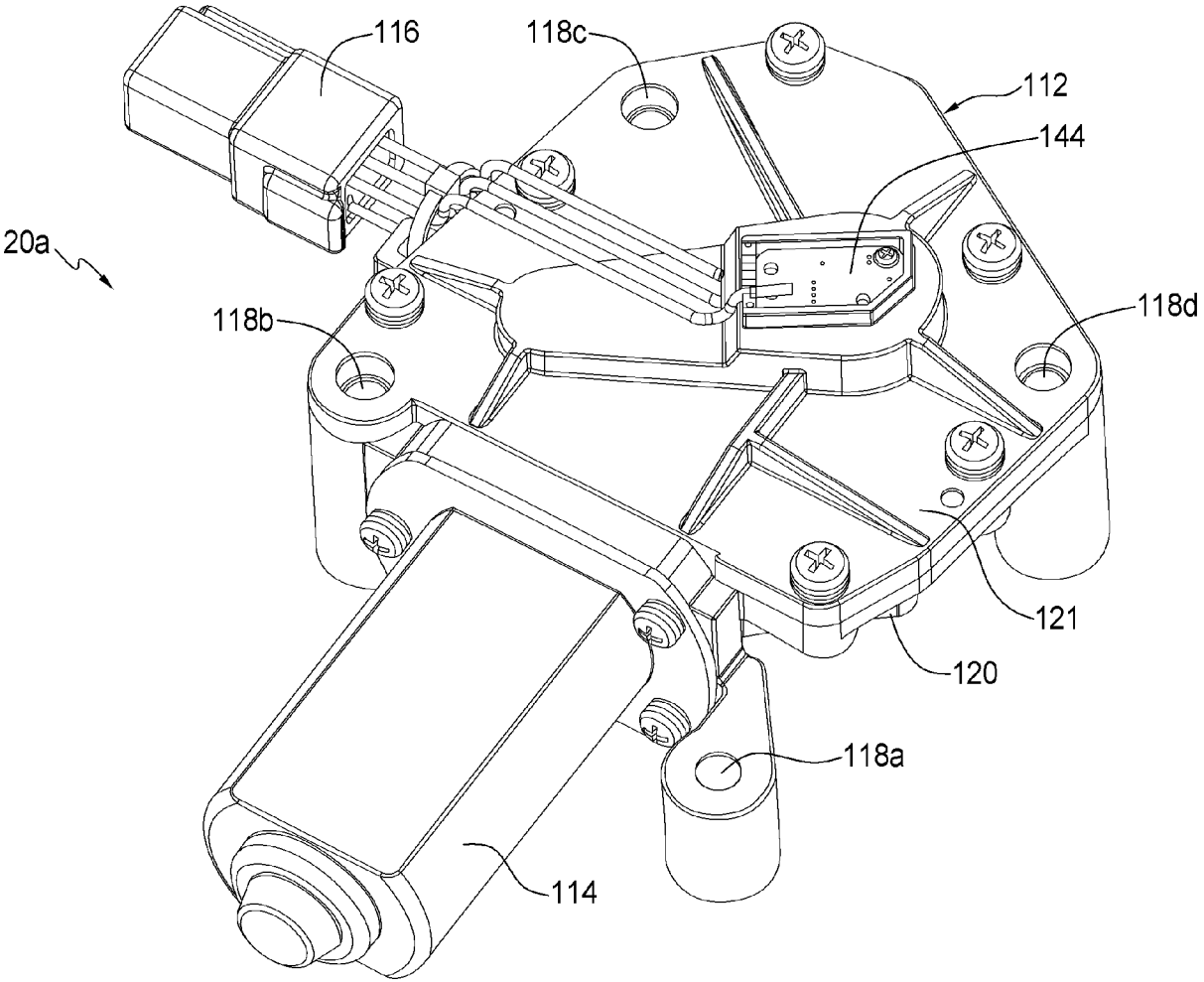
FIG. 10 is a perspective view of the throttle actuator of FIG. 8 illustrating the first side thereof.
Figure 11:
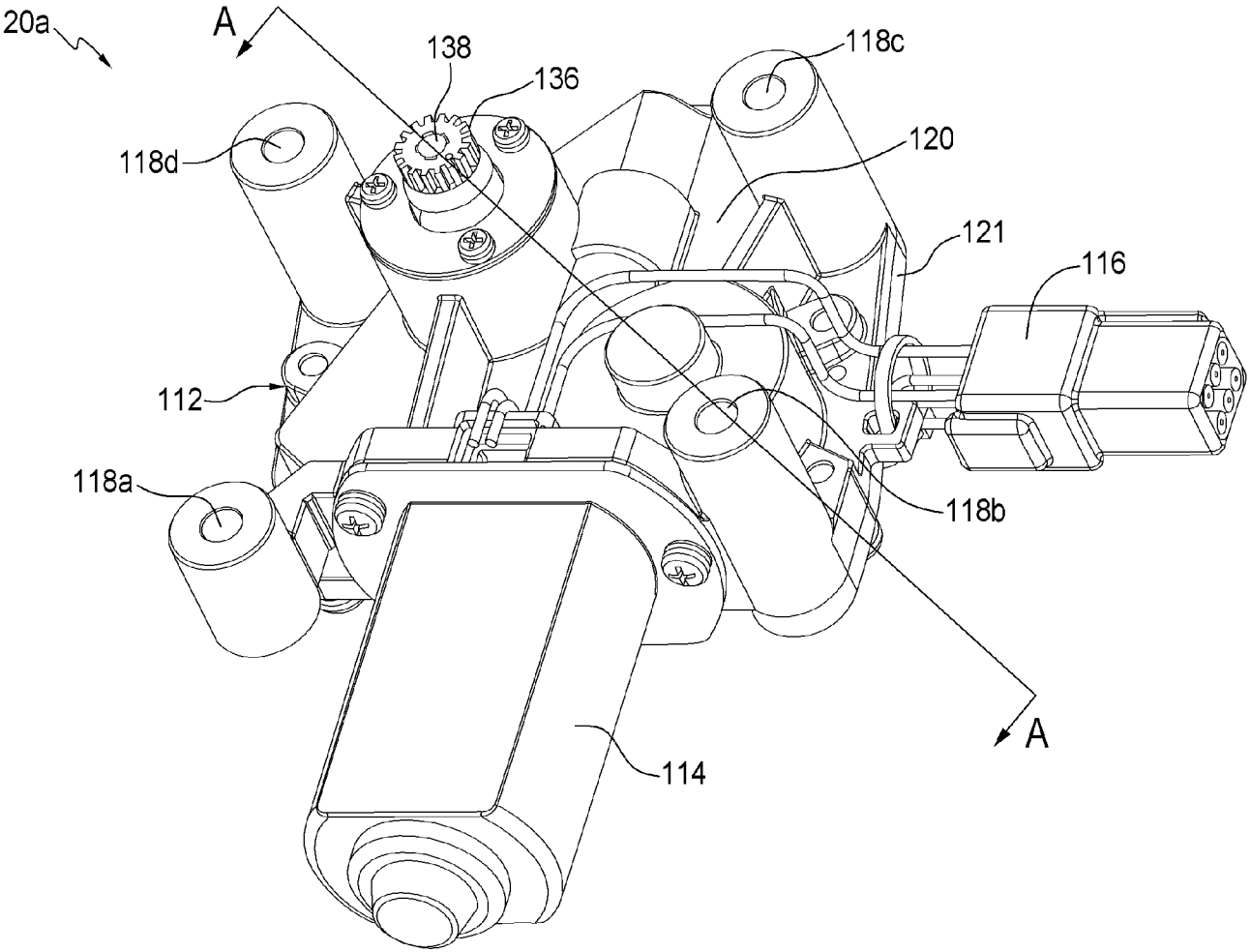
FIG. 11 is a perspective view of the throttle actuator of FIG. 8 illustrating the second side thereof.

Referring to FIGS. 7 through 11, the throttle actuator 20*a* of the port engine 12*a* is shown in greater detail. The throttle actuator 20*a* generally includes a waterproof housing 112 which encases various components, a motor 114 extending from and bolted to the housing 112, and a harness 116 for electrically connecting the throttle actuator 20*a* to the electronic shift and throttle system 60. The housing 112 is provided with a plurality of mounting holes 118*a*, 118*b*, 118*c*, and 118*d* allowing the throttle actuator 112 to be mounted as needed. In this example, the housing 112 also includes a body 120 and a cover 121 bolted the body 120. Removing the cover 121 provides access to the various components encased in the housing 112. The motor 114 may be rotated in either a first rotational direction or a second rotational direction opposite to the first direction depending on the direction of the electric current supplied to the motor 114. As best shown in FIG. 11, the harness 16 is wired to the motor 114 and supplies an electric current thereto.

Figure 12:
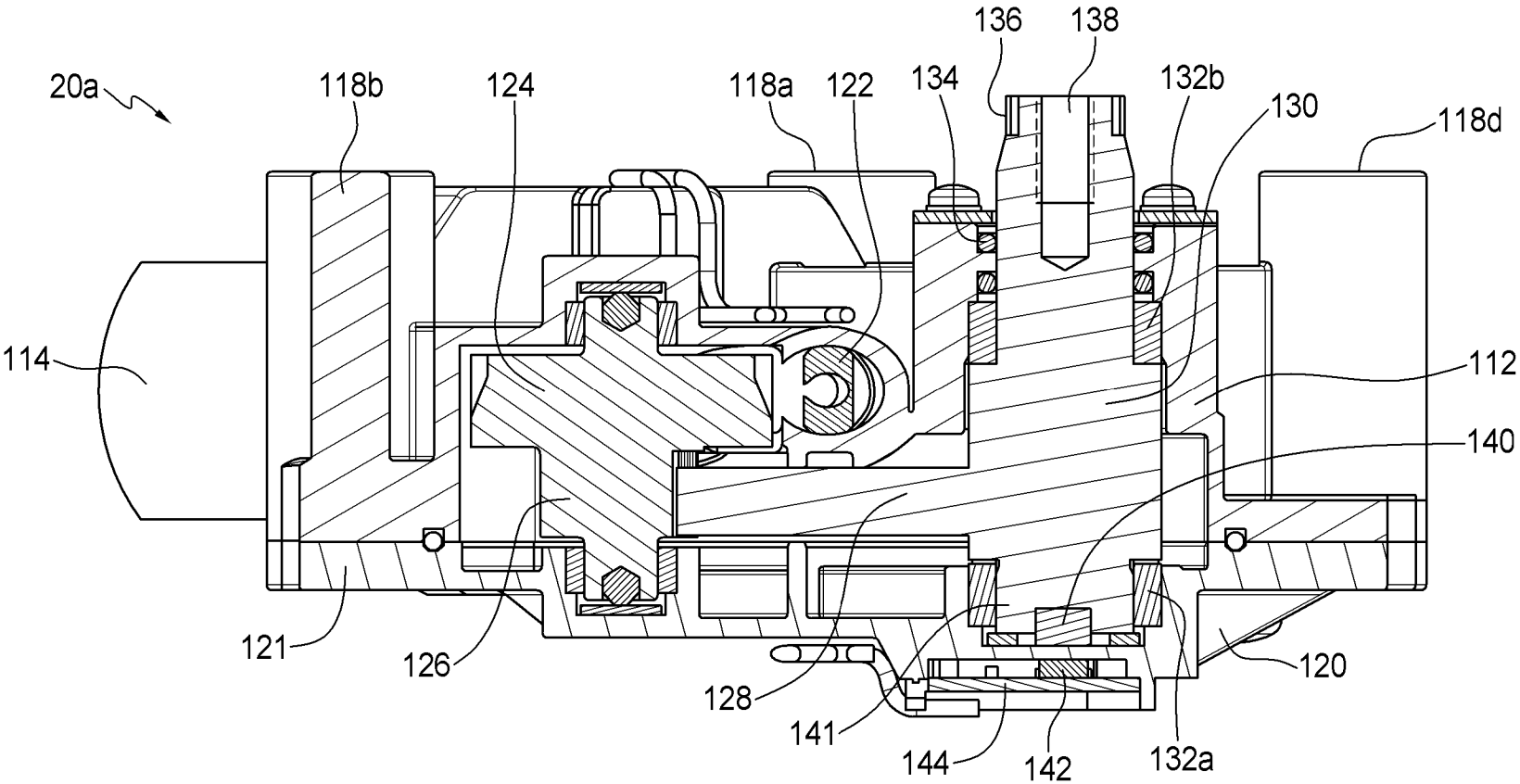
FIG. 12 is a sectional view taken along line A-A of FIG. 11.

Referring now to FIG. 12, the housing 112 encases a worm gear 122 which is coupled to an output shaft (not shown) of the motor 114. The worm gear 122 engages a worm wheel 124 which is integrated with a spur gear pinion 126. The worm gear 122 imparts rotary motion to both the worm wheel 124 and spur gear pinion 126. The spur gear pinion 126 imparts rotary motion to a sector spur gear 128 which is integrated with an output shaft 130 of the throttle actuator 20*a*. The output shaft 130 is thereby rotated by the motor 114. Bearings 132*a* and 132*b* are provided between the output shaft 130 and the housing 112 to allow free rotation of the output shaft 130 within the housing 112. A sealing member in the form of an O-ring 134 is provided about the output shaft 130 to seal the housing.

As best shown in FIG. 11, the distal end 136 of the output shaft 130 is splined. There is a longitudinal, female threaded aperture 138 extending into the output shaft 130 from the distal end 136 thereof. The aperture 138 is designed to receive a bolt to couple the output shaft 130 to the actuator arm 21*a* as shown in FIG. 8. Referring back to FIG. 12, there is a magnet 140 disposed at a proximal end 141 of the output shaft 130. There is also a position sensor 142 which senses a position of the magnet 140 as the output shaft 130 rotates. The position sensor 142 is thereby able to determine the rotating position of the output shaft 142. In this example, the position sensor 142 is a Hall Effect sensor but in other embodiments the sensor may be a magnetoresistive position sensor or another suitable magnetic rotational sensor. The position sensor 142 is mounted on a circuit board 144 which is mounted on the throttle actuator housing 112. More specifically, in this example, the circuit board 144 is mounted on the housing cover 121. As best shown in FIGS. 9 and 10, the circuit board 144 is wired to the harness 116 allowing the position sensor 142 to send an electrical signal to the ESM 22*a* which is shown in FIG. 4.

Figure 13:
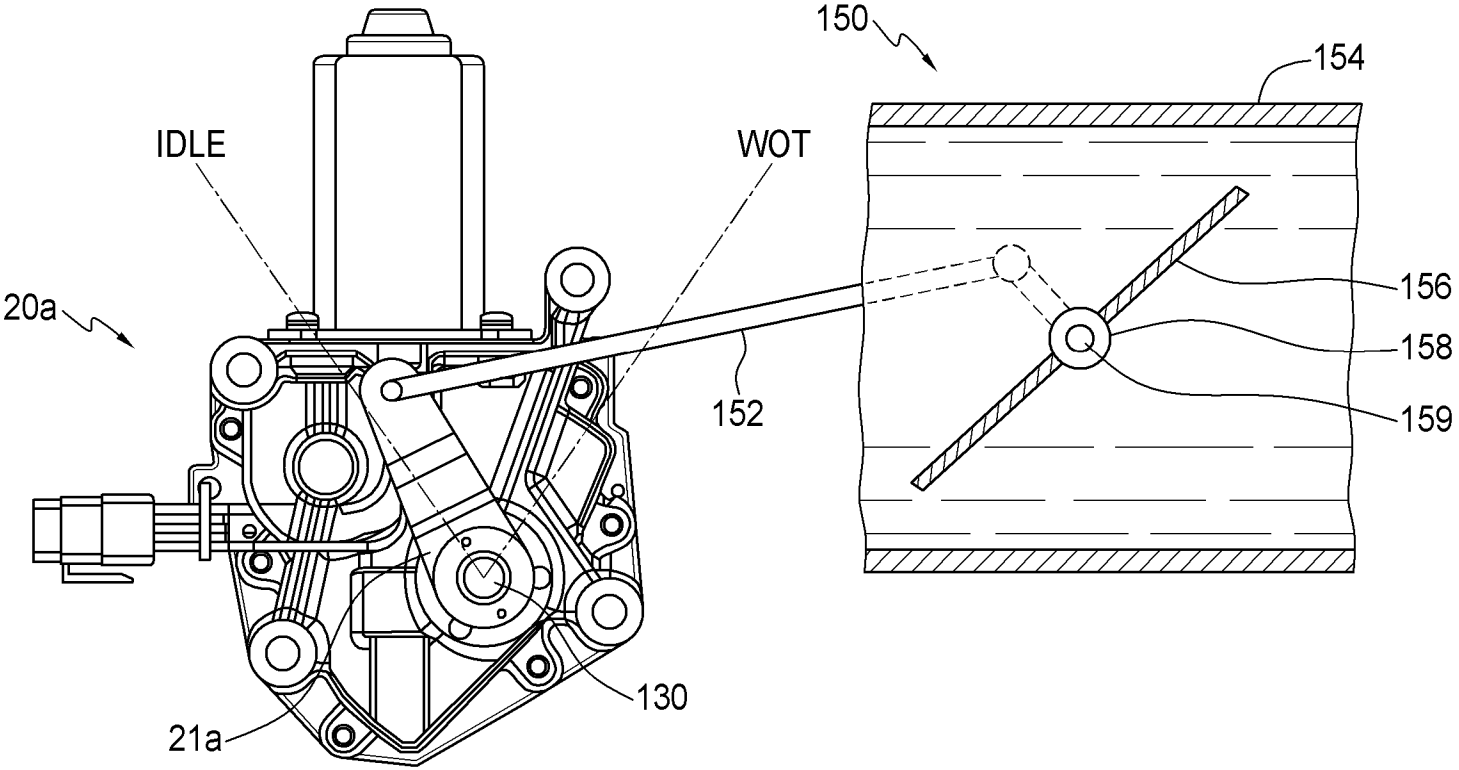
FIG. 13 is a fragmentary side view, partially in section and partly schematic, of the throttle actuator of FIG. 8, a throttle, and a linkage therebetween.

As best shown in FIG. 13, the actuator arm 21*a* is coupled to a throttle 150 of the port engine 12*a*, shown in FIG. 2, by a throttle linkage 152. The throttle 150 includes a throttle body 154 and a throttle plate 156 mounted on a rotatable throttle shaft 158. There is also a throttle position sensor (TPS) 159 mounted on top of the throttle shaft 158 which senses the position of the throttle shaft as it rotates. In this example, the TPS 159 is a potentiometer and communicates with the EMM 64*a* shown in FIG. 4. Together the plate 156, the shaft 158 and the TPS 159 form a butterfly valve member which is spring loaded to a closed position shown in FIG. 14. Referring back to FIG. 13, rotation of the actuator output shaft 130 drives the actuator arm 21*a* to rotate the throttle shaft 158. Rotation of the throttle shaft 158 causes the throttle 150 to move between an idle position shown in FIG. 14 and a WOT position shown in FIG. 15. Whether the throttle 150 is in the idle position or WOT position is dependent on the rotational position of output shaft 130. The throttle actuator 20*a* is an external actuator, the electronic shift and throttle system 60 may be installed as a kit on an existing engine.

To correlate position of the throttle 150 with the position of the actuator arm 21*a*, it is necessary calibrate the throttle controls of the electronic shift and throttle system 60. Once calibrated, the idle position of the actuator arm 21*a* will correspond to the idle position of the throttle 150.

Figure 15:
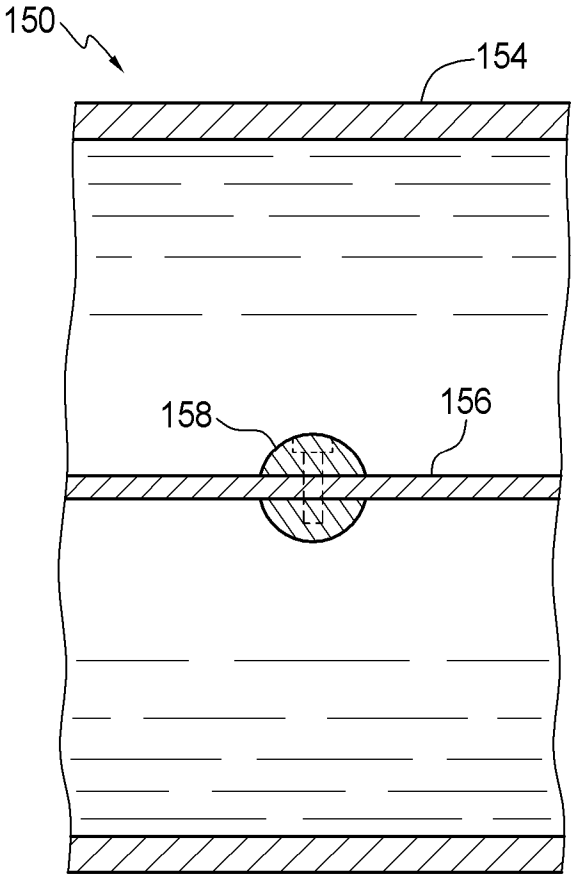
FIG. 15 is a sectional view of throttle of FIG. 13 illustrating the throttle in a wide open throttle (WOT) position.
Figure 14:
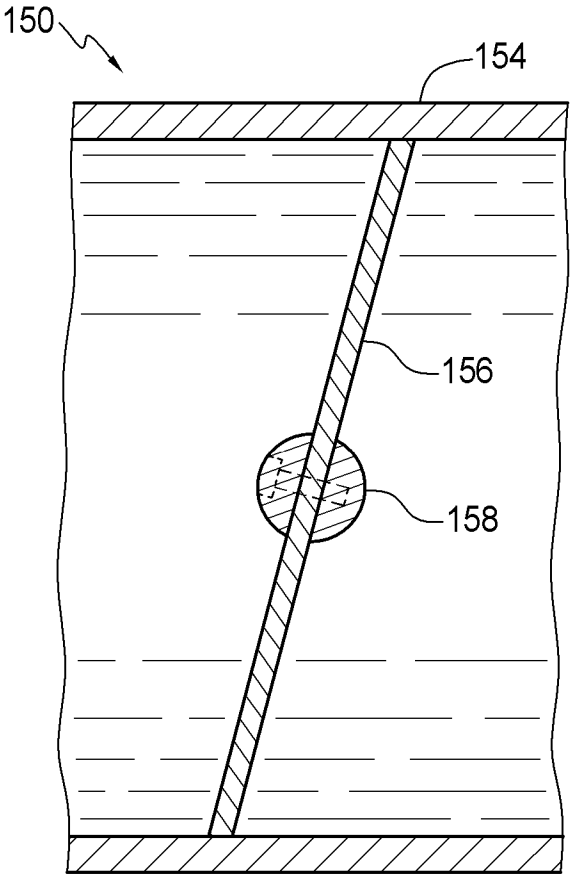
FIG. 14 is a sectional view of the throttle of FIG. 13 illustrating the throttle in an idle position.

The ESM 22*a*, shown in FIG. 4, calibrates the throttle controls by using the voltage level sent by the TPS 159, the duty cycle of the electrical signal sent by the actuator position sensor 142 and the amount of current flowing into the actuator motor 114. The voltage level of TPS 159 varies with the position of the throttle plate 156. In this example, the voltage level of TPS 159 is low when the throttle plate 156 is perpendicular and in contact with throttle housing 154, as shown in FIG. 14, and the voltage level of the TPS 159 is high when the throttle plate 156 is parallel with throttle housing 154 as shown in FIG. 15. The duty cycle of the electrical signal sent by the actuator position sensor 142 varies with the position of the throttle actuator arm 21*a*. In this example and as shown in FIG. 13, the duty cycle of position sensor 142 is low when the actuator arm 21*a* at the idle position and is high when the actuator arm 21*a* is at the WOT position. The amount of current flowing into the actuator motor 114 is low when the actuator arm 21*a* moves freely and increases when the throttle plate 156 is in contact with the throttle housing 154 thereby stalling the motor 114.

Figure 16:
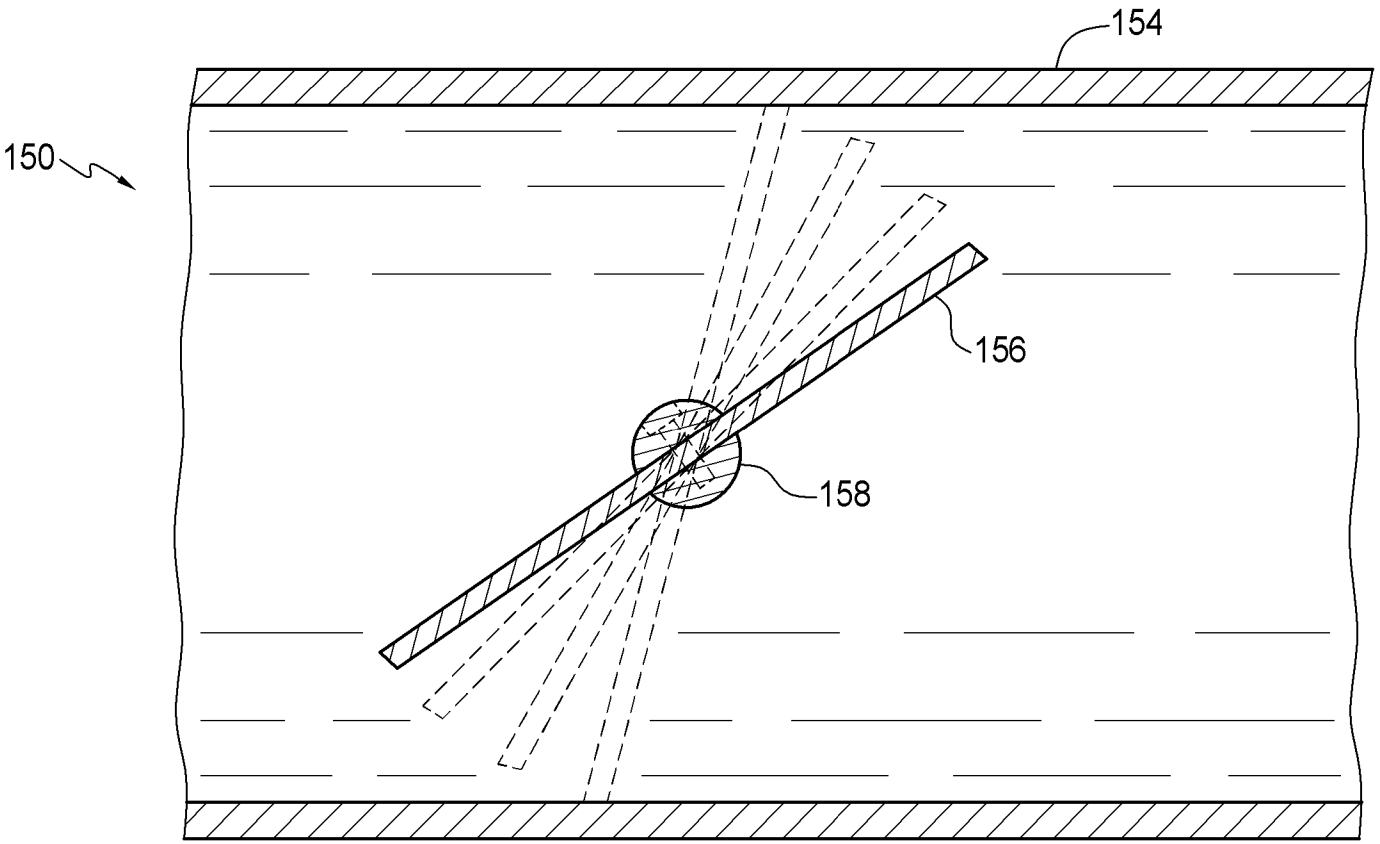
FIG. 16 is a sectional view of throttle of FIG. 13 illustrating movement of the throttle as the throttle controls are being calibrating.

The ESM 22*a* calibrates the throttle controls by determining the throttle position where the TPS voltage is the lowest, while avoiding residual tension in the throttle linkage 152. This is done by 20 opening the throttle 150 and moving it back to the idle position in increments. This is best shown in ghost in FIG. 16. The ESM 22*a* controls the opening of the throttle 150 and moves the throttle 150 back to the idle position. In this example, the throttle 150 is moved back in increments of 1° towards a hard stop, i.e. where the throttle plate 156 comes into contact with the throttle housing 154. At each increment the ESM 22*a* communicates 25 with the EMM 64*a* and requests the voltage level of the TPS 159 shown in FIG. 13. The ESM 22*a* stores the value. This is repeated until the throttle plate 156 comes to the hard stop. The ESM 22*a* determines if the throttle 150 is at the hard stop by measuring the current flowing in the actuator motor 114. The ESM 22*a* assumes that the throttle 150 is at the hard stop if the current is above a pre-determined value. The ESM 22*a* then establishes the idle position as being where the lowest valid voltage level that is at least a minimal distance away from hard stop was measured. The minimal distance from the hard stop ensures that the tension created in the throttle linkage 152 while moving the throttle plate 156 against the hard stop is released. In this example, the minimal distance is defined in degrees and set to 0.75°. However, the minimal distance may range for example between 0.3° and 1.5°.

In this example, the calibration procedure will terminate successfully if the following parameters are met:

1. The voltage level of the signal from the throttle position sensor has changed more than the movement amount while calibrating (in this example 0.2V). This amount confirms the actuator actually moved the throttle plate.
2. The minimum expected idle position voltage level (in this example 0.3V)<=the voltage level of the signal from the throttle position sensor in the idle position<=the maximum expected idle position voltage level (in this example 0.62V).

The values may vary in other embodiments.

Figure 17:
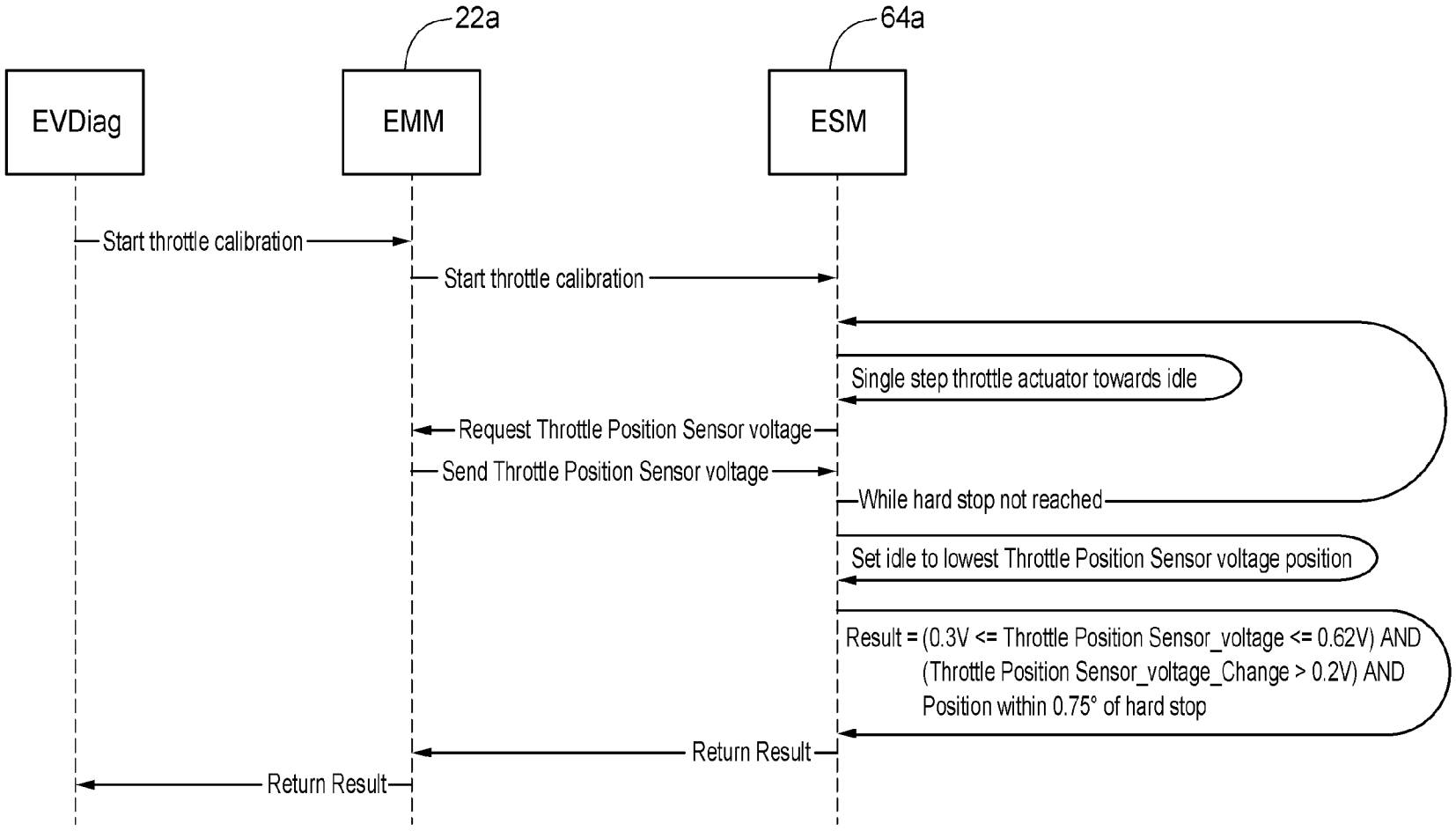
FIG. 17 is a flow chart illustrating the logic of a throttle calibration method disclosed herein.

FIG. 17 best shows the above described calibration procedure. The new calibration position is stored in EEPROM if the calibration procedure terminates successfully. A similar calibration procedure is used for the center and starboard engines.

Figure 18A:
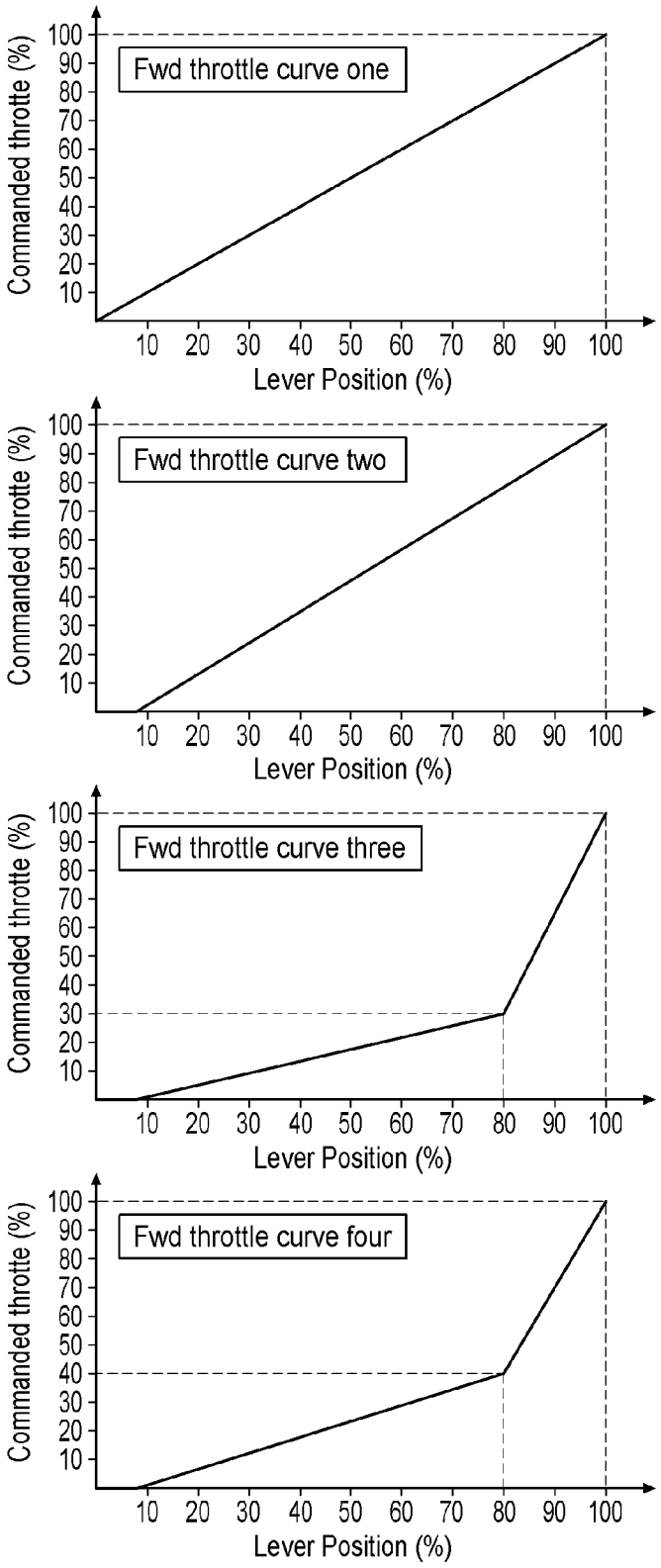
FIGS. 18A and 18B are charts illustrating a plurality of forward throttle curves.
Figure 18B:
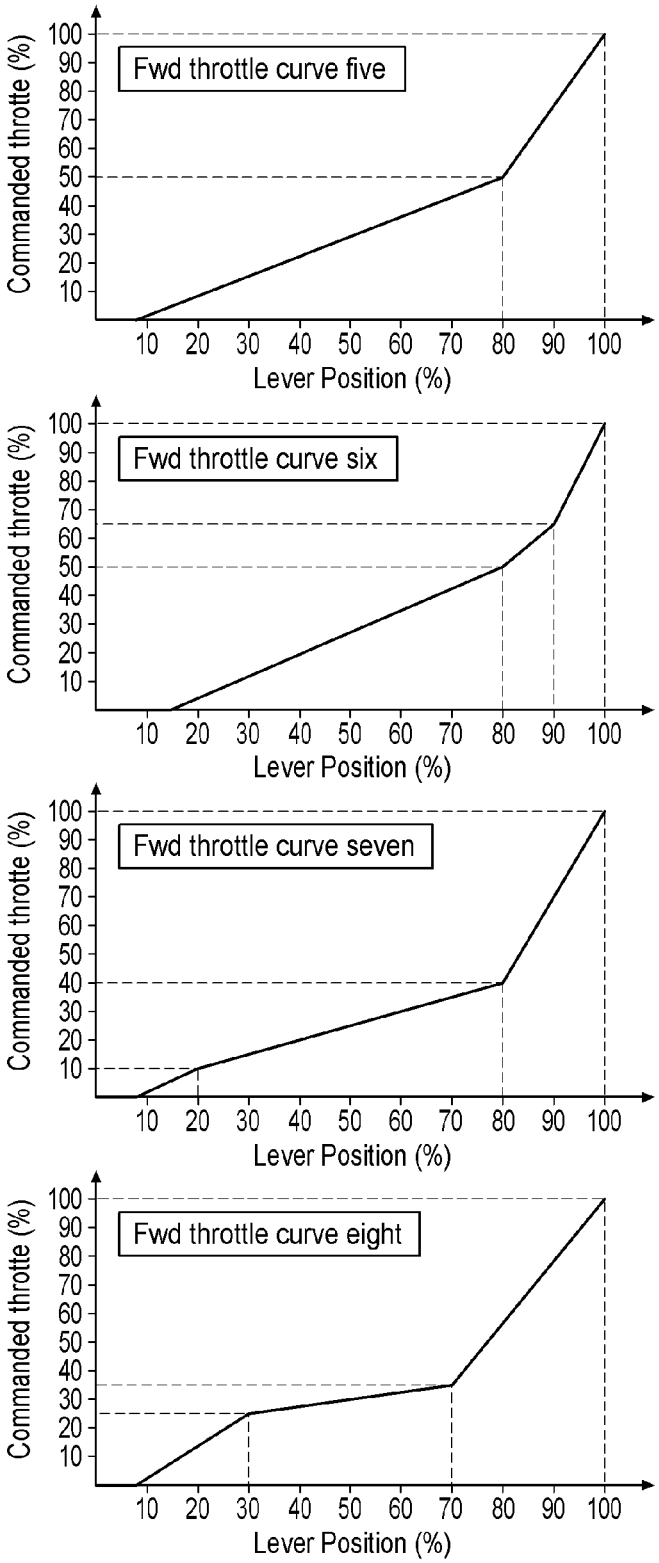
Figure 19A:
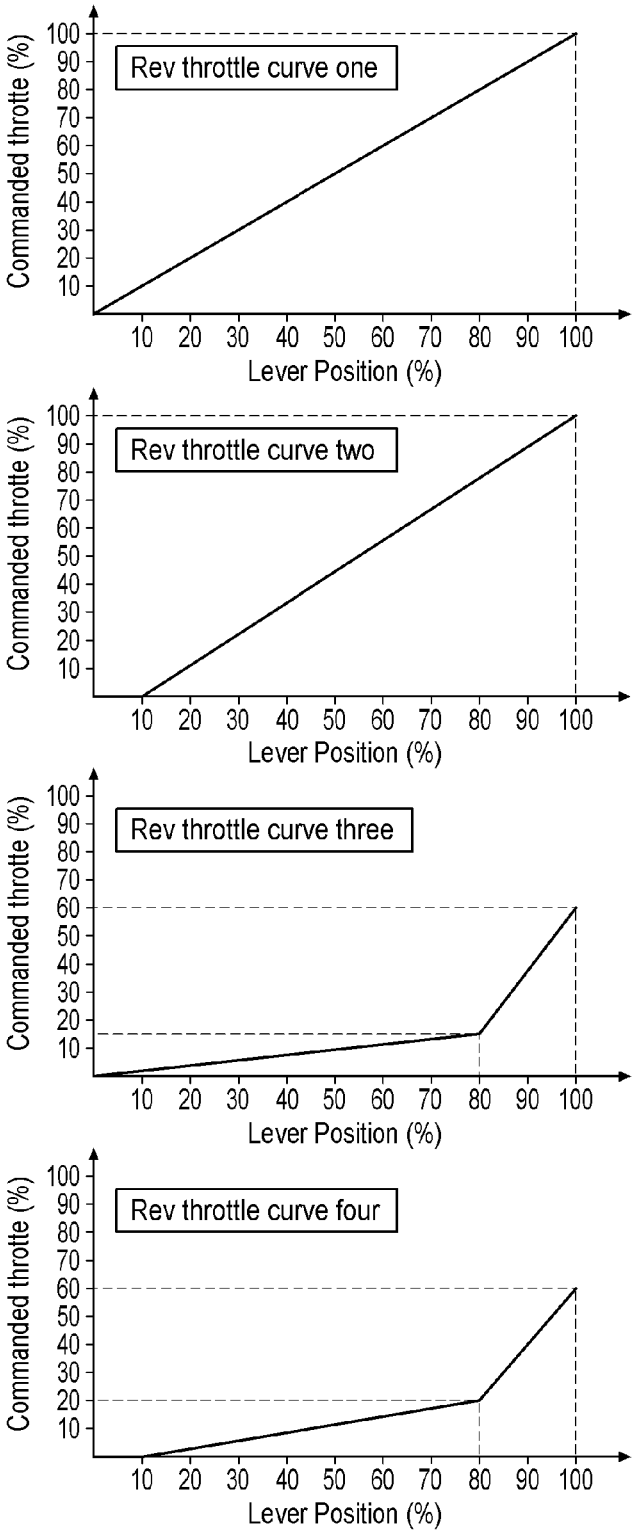
FIGS. 19A and 19B are charts illustrating a plurality of reverse throttle curves.
Figure 19B:
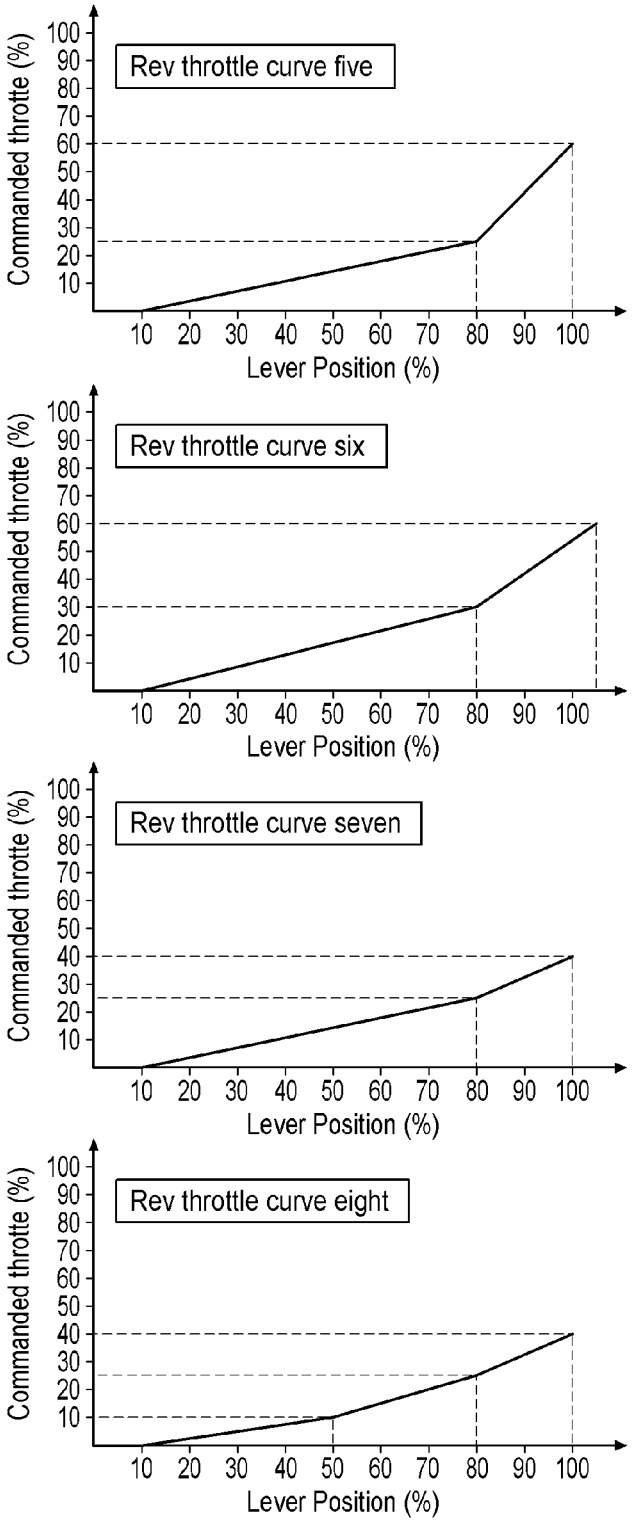

Referring back to FIG. 3, once the calibration procedure is completed the operator can more accurately increase or decrease the engine throttle by moving the port control lever 30 or starboard control lever 40 through its operational range, knowing the exact location of the idle position. The control head 16 uses a throttle curve to determine a throttle command based on the position of the control lever. A throttle curve is a two dimensional table which defines a relationship between a throttle value determined from the position of the control lever and the actual command sent to an ESM 22*a*, 22*b* or 22*c* shown in FIG. 4. In the electronic shift and throttle system disclosed herein a throttle curve is defined with five points. Interpolation is used to calculate the throttle command for control lever positions that fall in between the points. As shown in FIGS. 18 and 19, in this example, the control head 16 holds a total of eight forward throttle curves and eight reverse throttle curves. However, the control head 16 only uses one forward throttle curve and one reverse throttle curve at any given time. The default forward throttle curve is forward throttle curve number six. The default reverse curve is reverse throttle number six. The throttle curves being used can be selected by changing the control head settings.

The operator can also increase and decrease engine throttle without having to move the control levers 30 and 40 shown in FIG. 3. The RPM input means 52 of the control head 16 includes an RPM+ input means 51 which increases engine speed and RPM− input means 53 which decreases engine speed. In this example, the RPM+ input means and RPM− means are buttons but any suitable input devices may be used. Pressing the RPM+ input means 51 increases the throttle command sent through the CAN network to the ESM by a predetermined amount, e.g. 0.5% to 1%. Increasing the engine throttle with the predetermined amount, e.g. 0.5%, normally results in a repeatable amount of engine RPM increase, e.g. 50 RPM when the vessel is on plane. Pressing the RPM− input means 53 decreases the throttle command sent through the CAN network to the ESM by a predetermined amount, e.g. 0.5% to 1%. The increases and decreases to the throttle command are added to the throttle command as determined based on the position of the control lever and the throttle curve being used. The throttle command is only adjusted when all running engines are in the forward gear. The adjusted throttle command is applied to all running engines.

In this example, the throttle command adjustment is limited to a 5% adjustment. Pressing the RPM+ input means 51 when the throttle command has already been increased by 5% or the throttle reaches 100% will not result in further adjustment. Similarly, pressing the RPM− input means 53 when the throttle command has already been decreased by 5% or the throttle reaches 0% will not result in further adjustment. A throttle command of 0% corresponds to the idle position and a throttle command of 100% corresponds to the WOT position.

Moving either of the control levers 30 or 40 in any direction cancels the adjusted throttle command and disengages the adjustment function. The throttle command is then based on the position of the control levers 30 or 40 and the throttle curve being used. The new throttle command may be also be adjusted by pressing the RPM+ input means 51 or RPM− input means 53 as required. Accordingly, the electronic shift and throttle system disclosed herein allows the operator finely increase or decrease engine throttle. The electronic shift and throttle system disclosed herein also allows the operator increase or decrease engine throttle without having to move a control lever.

In this example, the throttle command may be adjusted by 5%. The total adjustment can be defined as an adjustment range required to change engine RPM. The optimal adjustment range is between 3% and 10%. The lower limit of the optimal adjustment range provides enough adjustment change engine RPM. The upper limit of the optimal adjustment range ensures that when the RPM adjustment function is disengaged, the increase or decrease to engine RPM is not too large and remains predictable.

Figure 20:
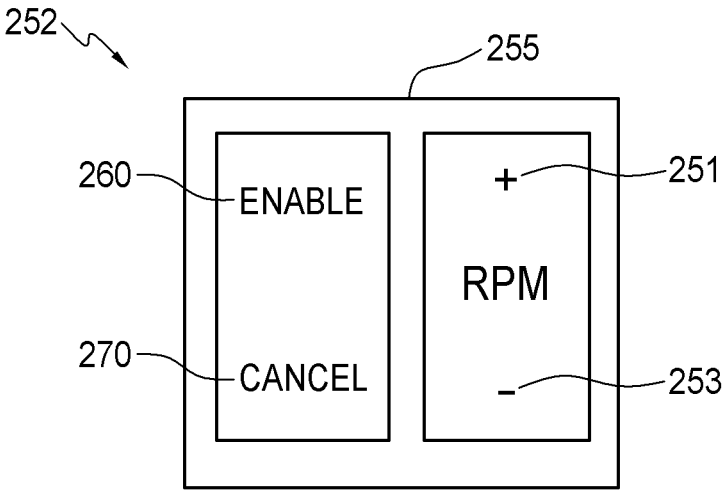
FIG. 20 is a plan view of a switch panel which supports an RPM adjustment input means.

In other embodiments, as shown in FIG. 20, an RPM input means 252 can be mounted on a switch panel 255. A new throttle command is adjusted by pressing the RPM+ input means 251 or RPM− input means 53 as required. The enable button 260 activates the feature while the cancel button 270 deactivates the feature. The switch panel 252 may be mounted anywhere on a marine vessel as an aftermarket accessory. For example, the switch panel 252 may be mounted on the dock or stern to allow fine adjustment of the throttle command. Fine control of the engine speed is important, especially while trolling or water skiing.

It will be understood by a person skilled in the art that the method and system for increasing or decreasing engine throttle disclosed herein may be implemented in any electronic shift and throttle control system, regardless of whether the vehicle is a marine vessel.

It will further be understood by a person skilled in the art that many of the details provided above are by way of example only, and are not intended to limit the scope of the invention which is to be determined with reference to following claims.

What is claimed is:

1. A method for adjusting engine throttle in an electronic shift and throttle system, the method comprising the steps of:

determining a position of a control lever which allows an operator to manually control throttle functions at a control head;

determining a throttle command, at the control head, based on the position of the control lever and sending the throttle command to a plurality of electronic servo modules each of which control a corresponding actuator disposed within an engine cowling; and adjusting the throttle command, at the control head, in response to a user input received from an input and sending an adjusted throttle command to each of the electronic servo modules;

wherein the position of the control lever remains constant as the throttle command is being adjusted.

2. The method as claimed in claim 1 wherein the step of determining the throttle command includes using a throttle curve to determine the throttle command.

3. The method as claimed in claim 1 further including the step of cancelling the adjusted throttle command when the control lever is moved.

4. The method as claimed in claim 1 further including the step of adjusting the throttle command between 0.5% and 1% in response to each input received from the input.

5. The method as claimed in claim 4 further including the step of limiting adjustment of the throttle command to between 3% and 10%.

6. The method as claimed in claim 1 wherein the step of adjusting the throttle command includes increasing the throttle command.

7. The method as claimed in claim 1 wherein the step of adjusting the throttle command includes decreasing the throttle command.

8. The method as claimed in claim 1 wherein the throttle command is only adjusted if all running engines in the electronic shift and throttle system are in forward gear.

9. The method as claimed in claim 1 wherein the step of adjusting the throttle command includes finely adjusting the throttle command.

10. An electronic shift and throttle system comprising:

a control head including a pivotable control lever for manually controlling throttle functions, the control lever being moveable through a range of positions and the control head determining a throttle command based on a position of the control lever;

a first engine including a throttle and a throttle actuator for moving the throttle between an idle position and a wide open throttle position, said throttle actuator being disposed within a cowling of the first engine;

a first electronic servo module which receives the throttle command from the control head and causes the throttle actuator of the first engine to move the throttle of the first engine;

a second engine including a throttle and a throttle actuator for moving the throttle between an idle position and a wide open throttle position, said throttle actuator being disposed within a cowling of the second engine;

a second electronic servo module which receives the throttle command from the control head and causes the throttle actuator of the second engine to move the throttle of the second engine;

a user input at the control head for increasing the throttle command without moving the control lever; and a user input at the control head for decreasing the throttle command without moving the control lever;

wherein the control head adjusts the throttle command based on input from at least one of the user input at the control head for increasing the throttle command and the user input at the control head for decreasing the throttle command, and wherein the control head sends an adjusted throttle command to the first electronic servo module and the second electronic servo module.

* * * * *